US009404305B1

(12) United States Patent
Messick

(10) Patent No.: US 9,404,305 B1
(45) Date of Patent: Aug. 2, 2016

(54) PORTABLE AND ADAPTABLE PLATFORM

(71) Applicant: Mark S. Messick, Coweta, OK (US)

(72) Inventor: Mark S. Messick, Coweta, OK (US)

( * ) Notice: Subject to any disclaimer, the term of this patent is extended or adjusted under 35 U.S.C. 154(b) by 136 days.

(21) Appl. No.: 14/225,877

(22) Filed: Mar. 26, 2014

(51) Int. Cl.

| | |
|---|---|
| ***E06C 1/393*** | (2006.01) |
| ***E06C 7/16*** | (2006.01) |
| ***E06C 1/12*** | (2006.01) |
| *E06C 7/00* | (2006.01) |

(52) U.S. Cl.
CPC . *E06C 7/16* (2013.01); *E06C 1/125* (2013.01); *E06C 1/393* (2013.01); *E06C 7/00* (2013.01)

(58) Field of Classification Search
CPC ..... E06C 1/39; E06C 1/393; E06C 7/50; E06C 1/32; E06C 7/44; E06C 7/16; E06C 1/125; E06C 7/00
USPC ..... 182/45
See application file for complete search history.

(56) References Cited

U.S. PATENT DOCUMENTS

| | | | | |
|---|---|---|---|---|
| 590,872 | A | 9/1897 | Allen | |
| 1,028,362 | A | 6/1912 | King | |
| 3,058,542 | A | 10/1962 | Rogalla | |
| 3,554,318 | A * | 1/1971 | Knight | 182/24 |
| 3,866,715 | A | 2/1975 | Foulk | |
| 4,102,433 | A | 7/1978 | Valkenburgh | |
| 4,326,601 | A * | 4/1982 | Grove et al. | 182/2.11 |
| 4,934,485 | A * | 6/1990 | Purkapile | 182/20 |
| 4,947,959 | A * | 8/1990 | Yuen | 182/22 |
| 4,951,780 | A | 8/1990 | Kim | |
| 5,074,377 | A * | 12/1991 | Krause | 182/167 |
| 5,249,397 | A | 10/1993 | Monaco | |
| 5,279,387 | A * | 1/1994 | Swiderski | E06C 1/32 182/108 |
| 5,320,194 | A | 6/1994 | Bredijk | |
| 5,711,400 | A * | 1/1998 | Tan | 182/119 |
| 5,913,782 | A | 6/1999 | Monaco et al. | |
| 5,954,157 | A * | 9/1999 | Grimes et al. | 182/163 |
| 6,220,389 | B1 * | 4/2001 | Krause | 182/23 |
| 6,513,778 | B2 * | 2/2003 | Hefley et al. | 248/351 |
| 6,732,480 | B1 | 5/2004 | Smith et al. | |
| 6,745,869 | B2 | 6/2004 | Garrett | |
| 6,926,241 | B2 | 8/2005 | Garrett | |
| 7,264,082 | B2 | 9/2007 | Simpson et al. | |
| 7,686,134 | B1 * | 3/2010 | Harris | E04G 1/36 182/200 |
| 8,186,480 | B1 * | 5/2012 | Yoakum, Jr. | 182/118 |
| 8,464,833 | B2 | 6/2013 | Lee | |
| 2003/0127288 | A1 * | 7/2003 | Ed | E06C 1/36 182/206 |

(Continued)

FOREIGN PATENT DOCUMENTS

| | | |
|---|---|---|
| FR | 2606827 A | 9/1986 |
| GB | 2208888 A | 8/1987 |
| GB | 2281855 A | 3/1995 |
| WO | WO 9114840 A1 | 10/1991 |

OTHER PUBLICATIONS

The PiVit Roof Boot Photograph from the Internet by Provision Tools.

(Continued)

*Primary Examiner* — Daniel Cahn
(74) *Attorney, Agent, or Firm* — Dennis D. Brown; Brown Patent Law, P.L.L.C.

(57) ABSTRACT

A platform apparatus comprising: a deck structure; a ladder structure; and at least one hinge element which pivotably connects the ladder structure to the deck structure. The hinge element can be locked in a plurality of pivot angles of the ladder structure with respect to the deck structure in a range of from about 105° to about 150°.

9 Claims, 4 Drawing Sheets

(56) References Cited

U.S. PATENT DOCUMENTS

| | | | | |
|---|---|---|---|---|
| 2004/0129497 | A1* | 7/2004 | Weiss | E06C 1/32 182/163 |
| 2005/0173190 | A1 | 8/2005 | Garrett | |
| 2010/0071996 | A1* | 3/2010 | Huang | E04G 1/34 182/118 |
| 2010/0133041 | A1* | 6/2010 | Wang | E06C 1/125 182/108 |
| 2010/0157602 | A1* | 6/2010 | Nichols | 362/277 |
| 2011/0056764 | A1* | 3/2011 | Cross | E06C 1/32 182/27 |
| 2012/0080264 | A1 | 4/2012 | Lord | |
| 2012/0097481 | A1 | 4/2012 | Schienke et al. | |
| 2014/0274571 | A1* | 9/2014 | Aral Diaz | A63B 17/00 482/37 |

OTHER PUBLICATIONS

RoofStep Photograph from the Internet by Work Platforms.
Ladderworld.com printout from website.
quickstepanchor.com printout from website.
Little Giant Select Step Ladder Photograph from the Internet at http://www.prlog.org/11292610-little-giant-ladders-select-step-style.jpg.
Little Giant Ladder Photograph from the Internet at http://professional-power-tool-guide.com/wp-content/uploads/2012/02/Little-Giant-ladder-. . . .
Little Giant Ladder Photograph from the Internet at http://seattleladders.com/images/LG%20Plank.jpg.
meijer.com printout from website at http://www.meijer.com/assets/product_images/styles/xlarge/1003117_10104LG_A_400.jpg.

* cited by examiner

PORTABLE AND ADAPTABLE PLATFORM

FIELD OF THE INVENTION

The present invention relates to a portable platform which is adaptable and adjustable for supporting ladders, workers, and/or equipment in stairwells and on roofs, or on sloped or terraced yards, sloped driveways, and other surfaces having pitch angles ranging from low to steep.

BACKGROUND OF THE INVENTION

A need exists for a sturdy, portable platform which can be used to support ladders, workers, and/or equipment on roofs, on stairs, in stairwells, on sloped driveways, on terraced yards, and on other sloped or angled surfaces when painting or when doing repair, maintenance, construction, roofing, decorating, or other work. The sturdy, portable platform will preferable be collapsible for easy transport and storage. The platform will also preferably be adjustable to adapt to substantially any pitch angle of the base surface ranging from low to steep while providing optimum safety and stability which meets and preferably exceeds government standards.

SUMMARY OF THE INVENTION

The present invention provides a sturdy, portable platform apparatus which satisfies the needs discussed above.

In one aspect, there is provided a platform apparatus comprising: a deck structure; a ladder structure; and at least one hinge element which pivotably connects the ladder structure to the deck structure. The hinge element can be locked in a plurality of different pivot angles of the ladder structure with respect to the deck structure which are in a range of from about 105° to about 150°.

Further aspects, features, and advantages of the present invention will be apparent to those of ordinary skill in the art upon examining the accompanying drawings and upon reading the following Detailed Description of the Preferred Embodiments.

DETAILED DESCRIPTION OF THE PREFERRED EMBODIMENTS

Figure 1:
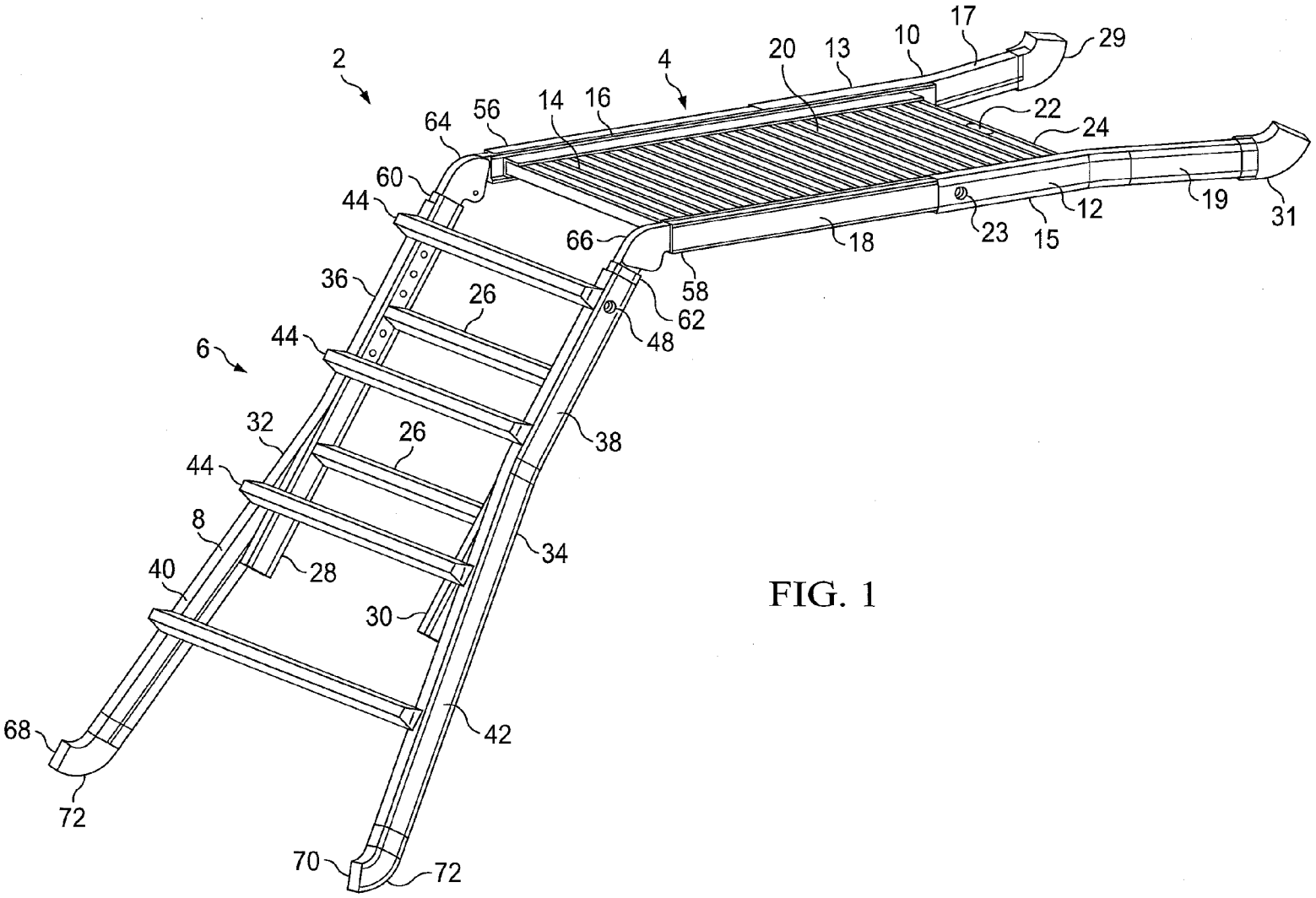
FIG. 1 is a perspective view of an embodiment 2 of a portable platform apparatus provided by the present invention.

An embodiment 2 of the portable platform apparatus provided by the present invention is illustrated in FIGS. 1-4. The platform apparatus 2 preferably comprises an extendable platform deck structure 4 and an extendable ladder structure 6 which is pivotably connected to the platform deck structure 4.

The extendable platform deck structure 4 preferably comprises (a) a deck 14 installed between a pair of deck side rails

16 and 18 and (b) a pair of adjustable platform extensions 10 and 12 which are slidably installed on the side rails 16 and 18. The deck side rails 16 and 18 will preferably be parallel but can alternatively diverge or converge toward or away from each other. The deck 14 can be formed of any material and/or deck components which are capable of supporting ladders, workers, and/or equipment when performing painting, construction, repair, maintenance, or other operations of this type.

The adjustable platform extensions 10 and 12 are preferably a pair of rail structures having (a) rearward portions 13 and 15 which are slidably installed on the deck side rails 16 and 18, (b) forward portions 17 and 19 which preferably diverge outwardly at an angle of at least 5° and more preferably from about 5° to about 20° and (c) forward contact elements 29 and 31 which, when the platform extensions are in either an extended or a non-extended position, will preferably rest on the roof, stairs, or other base surface upon which the inventive platform apparatus is deployed. The structure of the contacting elements 29 and 31 can by the same as the structure of the base contacting elements 68 and 70 discussed below.

As further discussed below, the platform extensions 10 and 12 can be particularly desirable for use, for example, when deploying the inventive platform apparatus 2 on a low pitch roof or other surface or structure having a low angle of incline (i.e., a low pitch angle).

To lock the platform extensions 10 and 12 into extended and/or retracted positions, the rearward portions 13 and 15 of the extensions 10 and 12 preferably each include a hole or slot 21 or 23 provided therein which can be aligned with one or a series of discrete holes, slots, or other mating features 25 formed in or through the distal (forward) end sections of the deck side rails 16 and 18 for receiving a locking pin or other locking element. To allow the platform extensions 10 and 12 to be locked into extended or retracted positions over a range of distances, each of the deck side rails 16 and 18 preferably includes a plurality (most preferably at least 3) of the extension apertures 25 spaced from about 1 to about 4 or more inches apart.

It will be understood, however, that clamps or other locking mechanisms could alternatively be used and that, instead of being lockable only in discrete positions 25, the platform extensions 10 and 12 could instead be lockable at substantially any point along a continuum extending from a non-extended position to a fully extended position.

In addition, as another alternative, the rearward portions 13 and 15 of the extensions 10 and 12 could include permanently installed retractable pins or other mechanisms which could be aligned with the holes, slots, or other mating features 25 of the deck side rails 16 and 18.

Also, it will be understood that the locking features of the extensions 10 and 12 and the deck side rails 16 and 18 can be reversed.

For strength and reduced weight, the deck 14 will preferably be formed of a plurality of interlocking aluminum panels or planks 20 installed between the deck side rails 16 and 18. Examples of such aluminum panels or planks 20 would include the interlocking aluminum "Reefer" planks and other types of interlocking aluminum planks which are commercially available from Ohio Gratings, Inc. An aperture 22 is preferable provide through the panel or plank at the forward end 24 of the deck 14 for receiving a rope, cord, or other member which could be used, for example, as a tie-off to further prevent the inventive platform apparatus 2 from sliding downward when the platform apparatus 2 is in use on a roof or other inclined surface.

The extendable ladder structure 6 preferably comprises (a) one or more (preferably two) steps 26 attached between a pair of ladder side rails 28 and 30 and (b) an adjustable extension assembly 8. The steps 26 can be rungs, panels, or steps of any other type used, for example, on regular ladders, extension ladders, step ladders, etc. To simplify the structure and operation of the ladder extension assembly 8, the ladder side rails 28 and 30 are preferably parallel.

The ladder extension assembly 8 preferably comprises a pair of rail structures 32 and 34 having (a) upper portions 36 and 38 which are slidably installed on the ladder side rails 28 and 30 and (b) lower portions 40 and 42 which preferably diverge outwardly at an angle of at least 5°, more preferably from about 5° to about 20°, to provide increased stability. To facilitate the sliding adjustment of the ladder extension assembly 8, the upper portions 36 and 38 of the extension side rails 32 and 34 are preferably parallel. The ladder extension assembly 8 preferably also includes a plurality of steps 44 of the same type discussed above (e.g., rungs, step panels, etc.) connected between the extension rail structures 32 and 34.

To lock the ladder extension assembly into extended and/or retracted positions, the upper portions 36 and 38 of the extension assembly side rail structures 32 and 34 preferably each include a hole or slot 46 or 48 provided therein which can be aligned with one or a series of discrete holes, slots, or other mating features 50 formed in or through the ladder side rails 28 and 30 for receiving a locking pin or other locking element. To allow the ladder extension assembly 8 to be locked in extended or retracted positions over a range of distances, each of the ladder side rails 28 and 30 preferably includes a plurality (most preferably at least 3) of the extension apertures 50 spaced from about 1 to about 4 or more inches apart.

It will be understood, however, that clamps or other locking mechanisms could alternatively be used and that, instead of being lockable only in a plurality of discrete positions, the ladder extension assembly 8 could instead be lockable at substantially any point along a continuum extending from a non-extended position to a fully extended position.

In addition, as another alternative, the upper portions 36 and 38 of the extension assembly rail structures 32 and 34 could include permanently installed retractable pins or other mechanisms which could be aligned with the holes, slots, or other mating locking features 50 of the ladder side rails 28 and 30.

Also, it will be understood that the locking features of the extension assembly rail structures and 32 and 34 and the ladder side rails 28 and 30 can be reversed.

Figure 2:
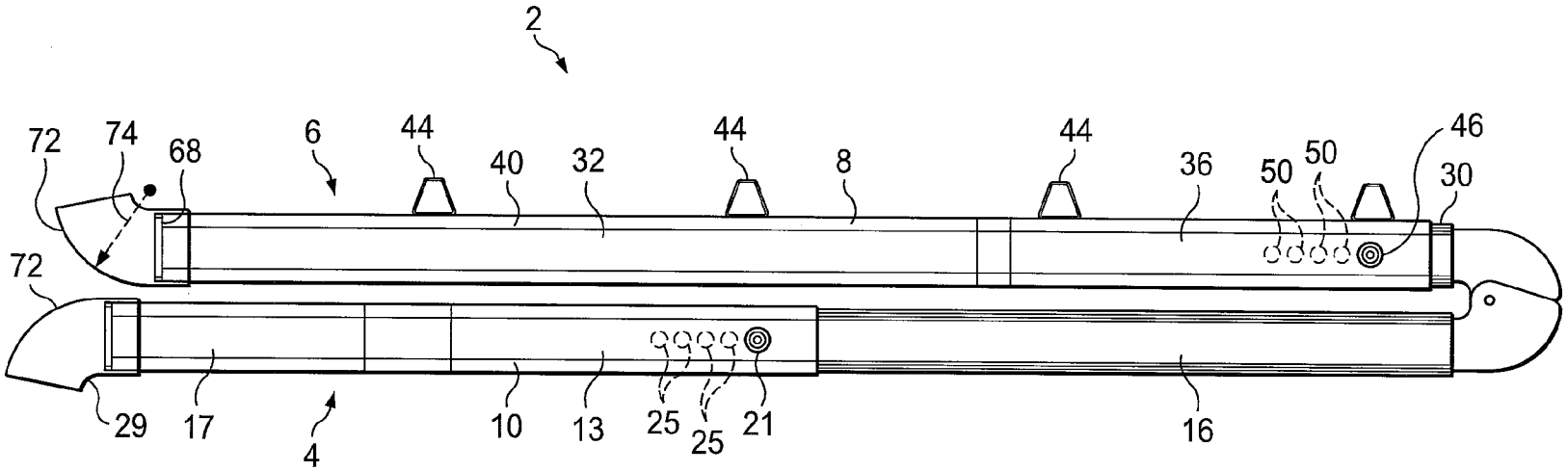
FIG. 2 is an elevational side view of the inventive platform apparatus 2 in folded position for storage or transport.
Figure 3:
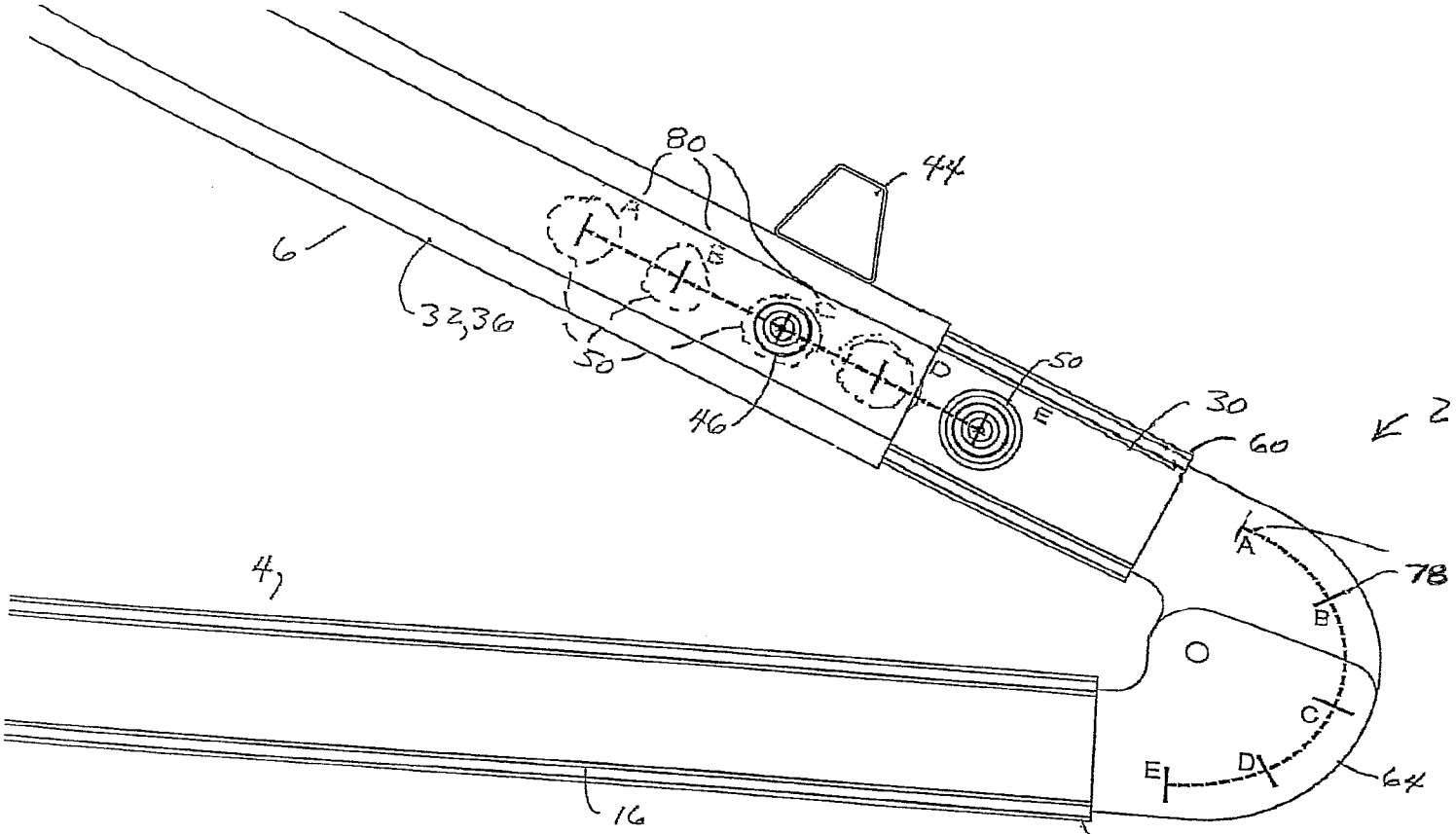
FIG. 3 is a side view of a section of the inventive platform apparatus 2 showing angle indicia 78 provided on a locking hinge 64 or 66 of the apparatus 2 and extension length indicia provided on an extendable ladder structure 6 of the apparatus 2.
Figure 4:
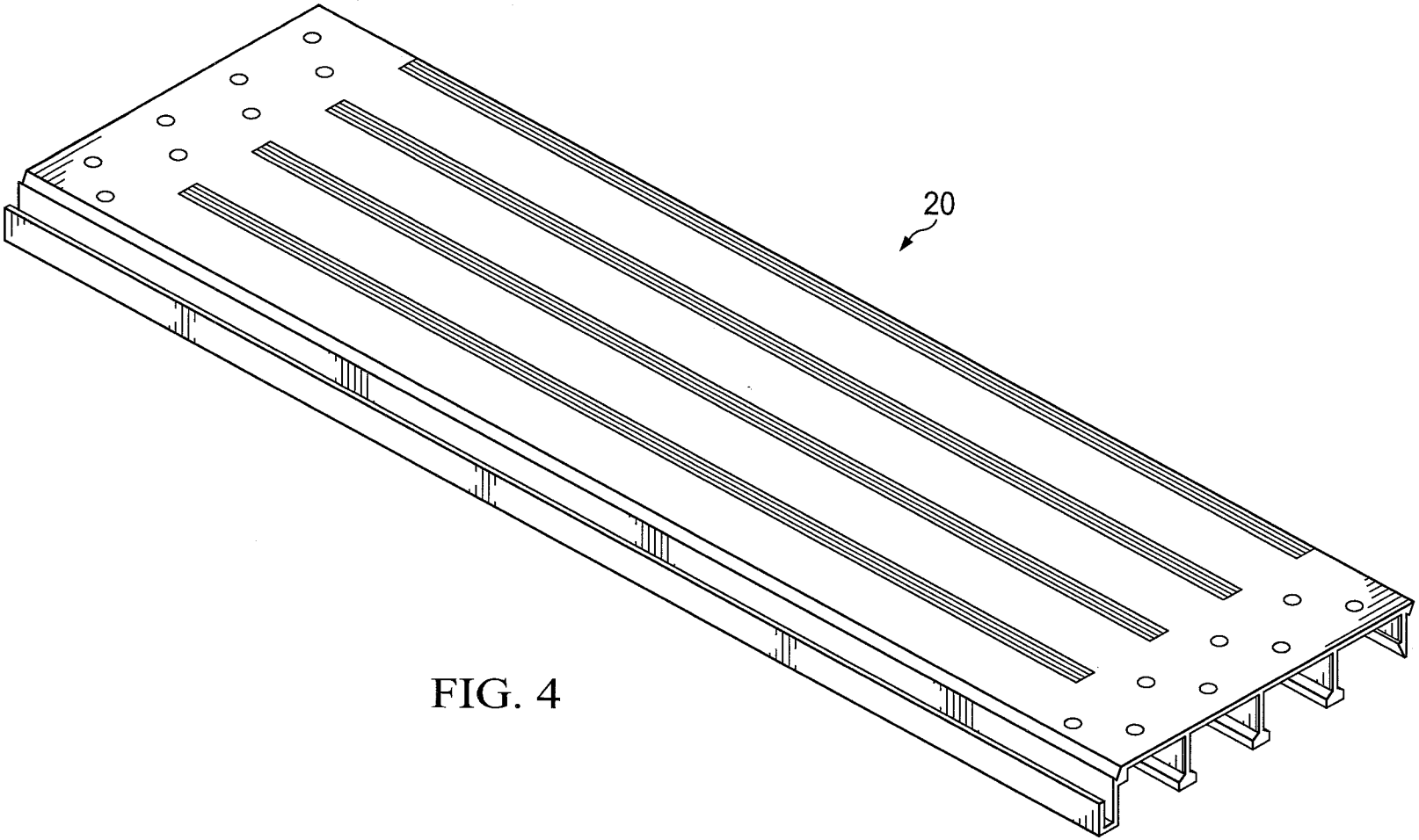
FIG. 4 is a perspective view of a platform deck panel 20 preferred for use in the inventive platform apparatus 2.

Generally any type of lockable hinge, or combination of hinges, can be used for pivotably connecting the platform deck structure 4 to the ladder structure 6. As shown in FIGS. 1-3, the proximal (rearward) ends 56 and 58 of the deck side rails 16 and 18 will preferably be pivotably connected to the upper ends 60 and 62 of the ladder side rails 28 and 30 using a pair of locking hinges 64 and 66 which are lockable in a plurality of different pivoted positions (i.e., at a plurality of different pivot angles of the platform deck structure 4 with respect to the ladder structure 6).

The locking hinges 64 and 66 will preferably have pivot settings which will allow the platform deck structure 4 to be locked with respect to the ladder structure 6 at angles of up to at least 130°, or more preferably up to at least 135° or 140° and still more preferably up to at least 145°. Most preferably, the locking hinges 64 and 66 will have pivot settings which will allow the platform deck structure 4 to be locked with respect to the ladder structure 6 at a plurality of different angles located within a range beginning at from about 105° to about 115° and ending at from about 140° to about 150°. In addition, although the locking hinges 64 and 66 will preferably be operable for locking the deck structure 4 with respect to the ladder structure at a plurality of predetermined discrete angles over these ranges, the inventive apparatus 2 can alternatively be operable for locking the deck structure 4 with respect to the ladder structure 6 at substantially any angle along a continuum preferably extending at least from a starting point in the range of from about 105° to about 115° to an ending point of from about 140° to about 150°.

The ladder extension assembly also preferably comprises a pair of base contacting elements 68 and 70 on the lower ends of the ladder extension side rails 28 and 30 for contacting the roof, steps, or other sloped surface upon which the inventive platform assembly 2 is placed. The base contacting elements 68 and 70 can be rounded rubber or plastic pads, pivotable feet, or any other type of base contacting elements used on ladders of any type.

It is more preferred, however, that the base contacting elements 68 and 70 used on the inventive platform apparatus 2 be continuously sloping elements of the type illustrated in FIGS. 1 and 2. The continuously sloping elements 68 and 78 have a base contacting surface 72 which is preferably in the shape of a segment of a circle. Preferably, the semicircular contacting surface 72 is oriented and extends over an arch length which is sufficient such that when (a) the platform deck structure 4 is deployed in horizontal position, (b) the base contacting elements are placed on a flight of stairs, a roof or other sloped surface having a pitch angle of up to at least 50° or up to at least 55°, and (c) the platform deck structure 4 is positioned with respect to the ladder structure 6 at any angle within the range of from 115° to 140° (more preferably from 110° to 145° and most preferably from 105° to 150°), the semicircular contacting surfaces 72 of the contacting elements 68 and 70 will rest upon and contact the base surface upon which the inventive platform apparatus 2 is placed.

In addition, to provide a desirably large frictional contact area between the semicircular contacting surfaces 72 and the stairs, roof, or other base surface upon which they are placed, the radius of curvature 74 of the semicircular contacting surfaces 72 will preferably be at least 3 inches, will more preferably be at least 4 inches, and will more preferably be at least 5 inches.

As illustrated in FIG. 2, when the inventive platform apparatus 2 is folded for storage or transport, the platform deck structure 4 and the ladder structure 6 will preferably be parallel or at least substantially parallel (i.e., +5°).

As illustrated in FIG. 3, one or both of the locking hinges 64 and 66 of the inventive platform apparatus 2 will preferably have angle indicia 78 provided thereon which correspond to and identify a plurality of lockable pivoted positions of the platform deck structure 4 with respect to the ladder structure 6. The angle indicia 78 can identify these different pivoted positions using letters, numbers, the actual pivot angles in degrees, or other identifiers.

Similarly, as further illustrated in FIG. 3, it is also preferred that extension length indicia 80 be provided on either or both of the ladder side rails 28 and/or 30, or on either or both of the ladder extension side rails 32 and/or 34, which correspond to and identify a plurality of lockable extension lengths of the ladder structure 6. The extension length indicia 80 will preferably correspond to the series of ladder extension apertures 50 provided in the ladder side rails 28 and 30 or alternatively in the extension side rails 32 and 34. The extension length indicia 80 can identify these different extension lengths using letters, numbers, the actual extension lengths, or other identifiers.

Moreover, it is preferred that some or all of the pivot angles identified by the angle indicia 78 and the extension lengths identified by the extension length indicia 80 be set such that a predetermined combination of one of the angle indicia 78 and one of the extension length indicia 80 will place the deck 14 of the inventive apparatus 2 in horizontal position at a pivot angle of the inventive apparatus 2 of at least 105° but not more than 150° on a sloped base surface (e.g., a roof or a set of stairs) having a pitch angle of 45° (i.e., a pitch of 12 inches down per 12 inches out).

In addition, it is also preferred that a different predetermined combination of one of the angle indicia 78 and one of the extension length indicia 80 will place the deck 14 in horizontal position at a pivot angle of the inventive apparatus 2 of at least 105° but not more than 150° on a sloped base surface having a pitch of 10 inches down per 12 inches out.

Further, it is also preferred that another predetermined combination of one of the angle indicia 78 and one of the extension length indicia 80 will place the deck 14 of the inventive apparatus 2 in horizontal position at a pivot angle of the inventive apparatus 2 of at least 105° but not more than 150° on a sloped base surface having a pitch of 8 inches down per 12 inches out.

Similarly, it is also preferred that yet another predetermined combination of one of the angle indicia 78 and one of the extension length indicia 80 will place the deck 14 of the inventive apparatus 2 in horizontal position at a pivot angle of the inventive apparatus 2 of at least 105° but not more than 150° on a sloped base surface having a pitch of 14 inches down per 12 inches out.

The relative length of the non-extended platform deck structure 4 with respect to the length of the non-extended ladder structure 6 will preferably be in the range of from about 80% to about 105% and will most preferably be about 92%. The relative length of the non-extended platform deck structure 4 with respect to the length of the fully extended ladder structure 6 will preferably be in the range of from about 50% to about 80% and will most preferably be about 68%. The relative length of the fully extended platform deck structure 4 with respect to the non-extended ladder structure 6 will preferably be in the range of from about 100% to about 140% and will most preferably be about 128%. The relative length of the fully extended platform deck structure 4 with respect to the fully extended ladder structure 6 will preferably be in the range of from about 80% to about 105% and will most preferably be about 94%.

Thus, the present invention is well adapted to carry out the objects and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within this invention as defined by the claims.

What is claimed is:

1. A platform apparatus positionable on a pitched roof or a set of stairs, the platform apparatus comprising:

a deck structure comprising a support deck having a planar upper surface, the support deck held by a pair of deck side rails for supporting a ladder, workers, equipment, or a combination thereof on the planar upper surface of said support deck, said deck structure further comprising at least one contacting surface at a forward end of said deck structure for contacting said pitched roof or said set of stairs, and said pair of deck side rails being configured to extend along a major length of said deck side rails and lock in a plurality of positions;

a ladder structure having a plurality of rungs connected between a pair of ladder side rails defining a major ladder length, said pair of ladder side rails configured to extend along said major ladder length and lock in a plurality of discrete extension positions, the ladder structure further having a pair of semicircular base contacting surfaces at a lower end of said ladder structure, said pair of contacting surfaces extending over an arch length configured to contact said pitched roof or said set of stairs, and said ladder structure further comprising respective extension indicia corresponding to and indicating said plurality of discrete extension positions; and at least one hinge element pivotably connecting an upper end of said ladder structure to a rearward end of said deck structure, the at least one hinge element comprising respective angle indicia corresponding to and indicating a plurality of discrete lockable pivot angles in a range of from about 105 degrees to about 150 degrees of said ladder structure with respect to said deck structure, said at least one hinge element configured to pivot and lock into said plurality of discrete lockable pivot angles, wherein said platform apparatus is configured to be locked into a plurality of predetermined combinations respectively defined by the ladder structure being locked at one of said extension indicia as the at least one hinge element is locked at one of said angle indicia, wherein each of said predetermined combinations are respectively configured to place said planar upper surface of said support deck in a horizontal position when each of said contacting surfaces rest upon a roof surface having a pitch of 12 inches down per 12 inches out, a pitch of 10 inches down per 12 inches out, a pitch of 8 inches down per 12 inches out, and a pitch of 14 inches down per 12 inches out.

2. The platform apparatus of claim 1 wherein said deck structure is foldable to a storage or transport position with respect to said ladder structure wherein said deck structure and said ladder structure are substantially parallel.

3. The platform apparatus of claim 1 wherein said extension positions include a non-extended position of said ladder structure.

4. The platform apparatus of claim 1, wherein said plurality of discrete lockable pivot angles is in a range of from about 105 degrees to about 145 degrees of said ladder structure with respect to said deck structure.

5. The platform apparatus of claim 1, wherein when said planar upper surface of said support deck of said deck structure is deployed in said horizontal position on the roof surface having a pitch angle of up to at least 50 degrees and said deck structure is positioned with respect to said ladder structure at a pivot angle in a range of from 110 degrees to 150 degrees, said semicircular base contacting surfaces will rest upon and contact said roof surface.

6. The platform apparatus of claim 5 wherein said semicircular base contacting surfaces have a radius of curvature of at least 4 inches.

7. The platform apparatus of claim 1 wherein said support deck of said deck structure is formed by a series of panels or planks installed between said deck side rails.

8. The platform apparatus of claim 7 wherein a tie-off aperture is formed through one of said panels or planks at a forward end of said support deck.

9. The platform apparatus of claim 1 wherein said deck structure further comprises a pair of adjustable forward deck structure extensions slideably positioned on said deck side rails, said deck structure extensions having forward ends, and wherein the at least one contacting surface of said deck structure is a pair of said contacting surfaces secured on said forward ends of said deck structure extensions.

* * * * *